United States Patent [19]

Renegar et al.

[11] Patent Number: 4,589,367

[45] Date of Patent: May 20, 1986

[54] SYSTEM FOR AUTOMATICALLY PAINTING PENCILS

[75] Inventors: Charles G. Renegar; Russell D. Agee, both of Shelbyville, Tenn.

[73] Assignee: Empire Enterprises, Inc., Shelbyville, Tenn.

[21] Appl. No.: 656,754

[22] Filed: Oct. 1, 1984

[51] Int. Cl.[4] ..... B05C 3/10

[52] U.S. Cl. ..... 118/66; 118/404

[58] Field of Search ..... 118/404, 405, 66, 58

[56] References Cited

U.S. PATENT DOCUMENTS

| | | | |
|---|---|---|---|
| 1,849,529 | 3/1932 | Leibold et al. | 118/66 X |
| 2,331,983 | 10/1943 | Kaiser, Jr. | 41/1 |
| 2,381,502 | 8/1945 | Lang | 91/2 |
| 2,865,785 | 12/1958 | Coles | 117/46 |
| 2,970,950 | 2/1961 | Bahmann | 204/26 |
| 4,263,348 | 4/1981 | Renegar | 427/286 |

FOREIGN PATENT DOCUMENTS

| | | | |
|---|---|---|---|
| 487109 | 12/1929 | Fed. Rep. of Germany | 118/404 |
| 2289623 | 5/1976 | France . | |
| 257226 | 10/1926 | United Kingdom | 118/404 |
| 749695 | 7/1980 | U.S.S.R. . | |

*Primary Examiner*—John P. McIntosh

*Attorney, Agent, or Firm*—Shapiro and Shapiro

[57] ABSTRACT

A system for automatically applying multiple coats of paint to pencils from a pencil production line comprises a plurality of paint stations arranged for sequentially applying respective coats of paint to the pencils. Each paint station includes a painting device, supply conveyor means for discharging pencils to that device and drying conveyor means for receiving pencils from the device. The first station in sequence receives pencils directly from the production line, and the conveyor means of consecutive stations are arranged so that the pencils are transported from one station to the next, all without manual intervention.

15 Claims, 3 Drawing Figures

SYSTEM FOR AUTOMATICALLY PAINTING PENCILS

BACKGROUND OF THE INVENTION

This invention relates to pencil manufacturing processes and more particularly to a system for automatically applying paint to pencils from a pencil production line.

The pencil manufacturing industry has seen significant technological advances over the years toward the production of an improved, low-cost product. These advances have largely focused on the pencil forming aspect of the manufacturing process, including, for example, the manufacture of pencil casings and leads by plastic extrusion techniques and the development of more fully automated, high-output production equipment. Pencil painting technology, however, has seen relatively few truly major improvements and has lagged significantly behind production equipment technology.

Modern pencil manufacturing facilities still make wide use of basic painting techniques which have been known for many years. For example, one long-known technique which is still commonly relied upon by the industry involves a pencil painting system basically consisting of a pair of paint machines interconnected by two paint-drying conveyors. Each paint machine includes a pencil supply hopper, a paint reservoir and a pusher for feeding pencils from the hopper through the reservoir. One of the drying conveyors runs between the output of the reservoir of the first paint machine and the supply hopper of the second paint machine and the other drying conveyor is similarly disposed between the reservoir of the second paint machine and supply hopper of the first paint machine. With this arrangement, pencils may be cycled between the two paint machines until a desired number of coats of paint has been applied.

Despite their long-standing use in the industry, pencil painting systems of the foregoing type are inefficient and labor intensive—and therefore, costly. For example, to operate such a system, it is necessary that factory personnel manually load a supply of pencils in the hopper of at least one paint machine and thereafter, upon completion of paint application, that the pencils be manually removed from the paint machine hoppers. This introduces delay in the manufacturing process, and a considerable number of systems may consequently be required to avoid a bottleneck in plant operations—particularly where modern, high-output pencil production equipment is being used. Naturally, the use of a large number of painting systems results in increased capital, maintenance and labor costs, and further wastes valuable in-plant floor space which could be utilized advantageously for other purposes.

It is appartent that an inexpensive, compact, and efficient pencil painting system which is compatible with today's high-output production equipment would be of great value to the pencil manufacturing industry. The present invention provides such a system.

SUMMARY OF THE INVENTION

Briefly stated, in one of its broad aspects, the invention provides a system for automatically applying multiple coats of paint to unfinished pencils from a pencil production line, comprising a plurality of paint stations each including paint means for receiving pencils and applying paint thereto, supply conveyor means for discharging the pencils to the paint means, and drying conveyor means for receiving the pencils from the paint means and drying the paint applied thereby. The plurality of stations is arranged in sequence for successively applying paint to the pencils, with the supply conveyor means of the first station in sequence having a zone for receiving pencils from the production line, and the supply conveyor means of each subsequent station being respectively cooperable with the drying conveyor means of the corresponding preceding station in sequence so that pencils may be transported from one paint station to the next. The drying conveyor means of the last station in sequence has a zone from which the pencils exit the system.

According to a further aspect of the invention, the paint means may comprise a pencil painting device of the type having a pencil supply hopper, a paint reservoir adjacent the hopper and means for feeding pencils from the hopper longitudinally through the reservoir along a substantially horizontal path. The supply conveyor means of each paint station may be disposed for discharging pencils to the supply hopper of the painting device associated with that station, and the drying conveyor means of each station may be disposed for receiving pencils as they exit from the paint reservoir of the associated painting device.

In a preferred form of the invention to be described hereinafter, at least one of the paint stations has supply conveyor means, including lift conveyor means, running in a first horizontal direction transverse to the pencil feed path of the corresponding painting device with one end disposed above the supply hopper of that painting device for discharging pencils thereinto. The drying conveyor means of that station includes a first conveyor running in a second horizontal direction opposite to the first horizontal direction and having one end adjacent the paint reservoir of the corresponding painting device for receiving pencils therefrom, and a second conveyor running in the first horizontal direction beneath the first conveyor and disposed so that pencils drop from the first conveyor to the second conveyor.

Further aspects and advantages of the invention will be apparent from the ensuing description of the preferred embodiment, with reference to the accompanying drawing.

DESCRIPTION OF THE PREFERRED EMBODIMENT

Figure 1:
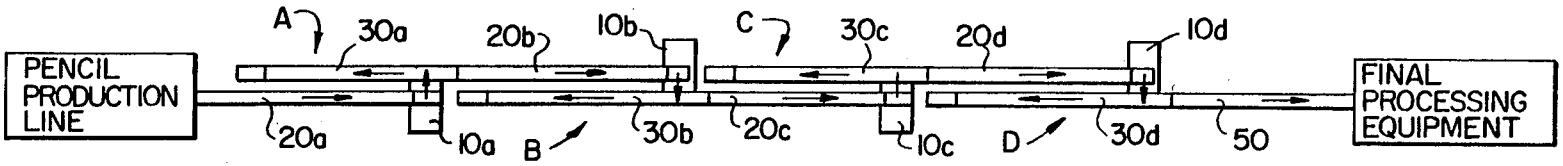
FIG. 1 is a diagrammatic plan view of a pencil painting system in accordance with the invention.

FIG. 1 illustrates the general layout of a preferred pencil painting system in accordance with the invention. In the form shown, the system includes four paint stations, designated A, B, C, and D, arranged in sequence for the application of four coats of paint to a supply of pencils. Each of the paint stations A–D includes respective paint means 10*a*, 10*b*, 10*c*, or lO*d* for receiving pencils and applying paint thereto, respective supply conveyor means 20*a*, 20*b*, 20*c*, or 20*d* for discharging pencils to the corresponding paint means and respective drying conveyor means 30*a*, 30*b*, 30*c* or 30*d* for receiving pencils from the corresponding paint means and drying the paint applied.

At each station pencils pass from the supply conveyor means through the paint means to the drying conveyor means, as indicated generally by arrows (FIG. 1). Additionally, in accordance with the invention, each station subsequent to the first in sequence (i.e., station A) has its respective supply conveyor means cooperable with the drying conveyor means of the corresponding preceding station so that pencils can be automatically transported from one station to the next. Thus, for example, supply conveyor means 20*b* is cooperable with drying conveyor means 30*a* to receive pencils therefrom. Similarly, supply conveyor means 20*c* is cooperable with drying conveyor means 30*b*, and supply conveyor means 20*d* is cooperable with drying conveyor means 30*c*. Details of this aspect of the invention will be given later.

As is apparent in FIG. 1, supply conveyor means 20*a* of station A has a zone for receiving pencils, preferably directly from a pencil production line (so designated), so that pencils are supplied to the painting system automatically (i.e., without manual loading). The pencil production line may, for example, be a high-output line such as the Hot Melt Pencil Production Line available from Bleistiftmaschinenfabric Dipl. Ing. Carl Zuber, Nurnberg, Germany and may be provided with an output conveyor (not shown) which supplies pencils directly to supply conveyor means 20*a*.

Drying conveyor means 30*d* of the last station in sequence (i.e., station D) has a zone from which pencils exit the system. In FIG. 1, for example, drying conveyor means 30*d* is cooperable with a further conveyor 50 which supplies the painted pencils to final processing equipment (so designated).

From the preceding discussion, it will be appreciated that with the arrangement shown in FIG. 1, unfinished pencils from the production line are fed directly to the painting system and then directly to final processing, with neither manual loading of pencils into the painting system nor manual unloading of pencils from the system being required.

Figure 2:
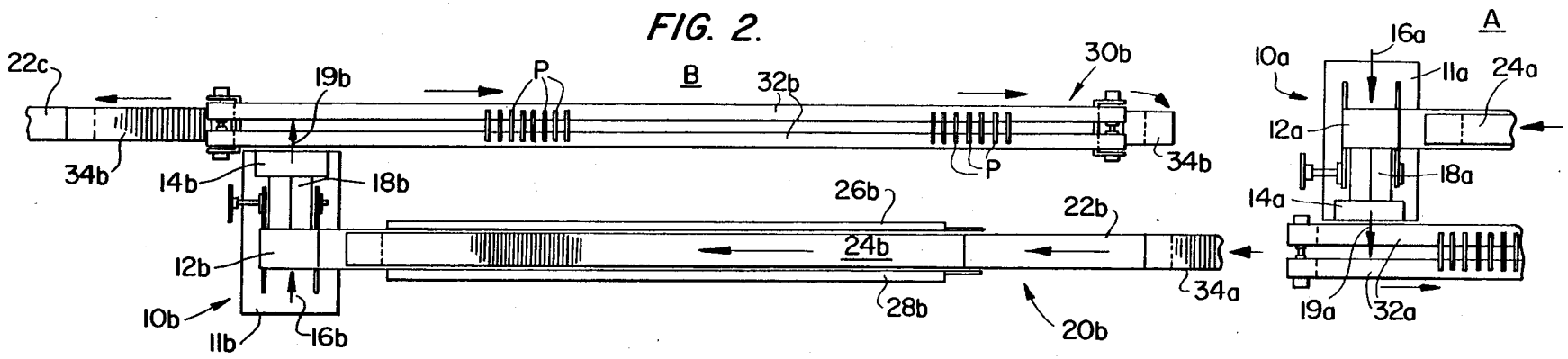
FIG. 2 is a diagrammatic plan view of one paint station, additionally showing portions of adjacent stations to illustrate the cooperation between consecutive paint stations.
Figure 3:
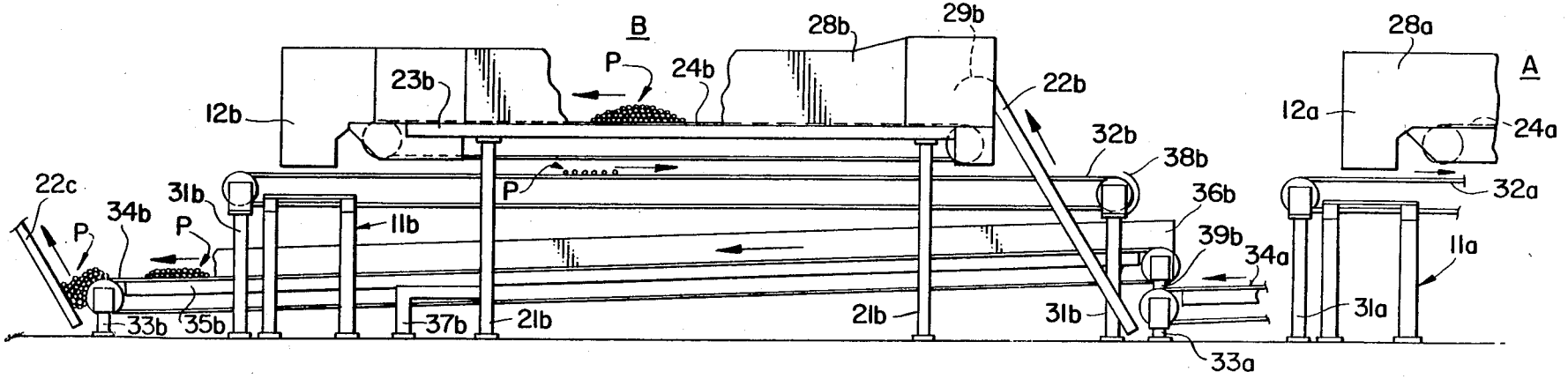
FIG. 3 is a side elevation of the apparatus of FIG. 2.

Having described the system of FIG. 1 generally, a preferred configuration of the individual paint stations will now be discussed with respect to FIGS. 2 and 3. The reader will note that the orientation of the apparatus in FIGS. 2 and 3 is reversed from that in FIG. 1, with the stations being arranged from right to left. The arrangement of the individual paint stations will be described with reference to station B. The remaining stations may be similarly constructed and will therefore not be described in detail. Portions of stations A and C have been shown in FIGS. 2 and 3 only to the extent appropriate to demonstrate the manner in which adjacent stations in sequence are cooperable in order for pencils to proceed automatically through the system.

As noted earlier, paint station B comprises paint means 10*b*, supply conveyor means 20*b* and drying conveyor means 30*b*. Referring to FIG. 2, paint means 10*b* (shown supported on a frame 11*b*) is preferably a pencil painting device of the well-known type having a pencil supply hopper 12*b*, a paint reservoir 14*b* and means for feeding pencils from the hopper longitudinally through the paint reservoir along a substantially horizontal path. The pencil feeding means includes the usual pusher apparatus, generally designated by arrow 16*b*, disposed beneath the hopper for pushing pencils through the reservoir via a guide assembly 18*b*. Arrow 16*b* also indicates the direction of the pencil feed path through the reservoir 14*b*. The reservoir is provided with appropriate openings (not shown) to accommodate the pencils, and nipple-type seals (not shown) which permit passage of the pencils and prevent paint leakage are located within the openings. Painting devices of this type are known throughout the industry and no further discussion of these devices is necessary for an understanding of the invention. The reader will note that paint means 10*a* and other portions of station A also appear in FIG. 2, with elements corresponding to those in station B being denoted by corresponding reference numerals followed by the subscript "a." For reasons to be addressed later, paint means 10*a* is oriented so that its pencils feed path is directed oppositely to that of paint means 10*b*, as indicated by arrow 16*a*. To simplify the drawing, only the respective hoppers 12*a* and 12*b* of paint means 10*a* and 10*b* have been shown in FIG. 3.

Continuing with the description of station B, supply conveyor means 20*b* includes a pair of conveyors 22*b* and 24*b* which transport pencils P in the directions indicated by corresponding arrows in the drawing. (It should be noted that on all conveyors in the painting system, pencils P are oriented with their lengths substantially perpendicular to the direction of travel.) Conveyor 22*b* is inclined for lifting pencils toward supply hopper 12*b* and may be a belt or chain conveyor having transverse members for carrying the pencils up the conveyor incline. Conveyor 24*b*, which runs in the same horizontal direction, and transverse to the pencil feed path indicated by arrow 16*b*, has one end positioned for receiving pencils from the upper end of conveyor 22*b* and another end positioned above hopper 12*b*, adjacent thereto, for discharging pencils into the hopper. Conveyor 24*b*, supported on a suitable frame 21*b*, 23*b* as shown diagrammatically in FIG. 3, may be an ordinary belt conveyor. Since it is preferable to have a large supply of pencils available to each painting device so that painting may continue in the event of a breakdown at a preceding station or in the production line, retaining walls 26*b* and 28*b* are located at either side of conveyor 24*b* so that pencils may be stacked on that conveyor in the manner depicted in FIG. 3. A practical technique for effecting such stacking will be discussed later.

Turning now to the drying conveyor means, it will be observed that conveyor means 30*b* includes a first conveyor 32*b* and a second conveyor 34*b*, the directions of which are indicated by corresponding arrows. Conveyor 32*b*, which is supported on suitable frame members 31*b* as seen in FIG. 3, is a dual belt conveyor of a form customarily used for drying paint applied to pencils. A first end of conveyor 32*b* is positioned adjacent reservoir 14*b* for receiving pencils as they exit the reservoir (see arrow 19*b*), and the conveyor runs in a horizontal direction parallel and opposite to that of supply conveyors 22*b* and 24*b*. Pencils are suspended individually between the two belts of the conveyor, which are provided with appropriate projections to keep the pencils apart from each other, so that the paint applied by paint means 10*b* may be dried.

As best seen in FIG. 3, conveyor 34*b* is disposed beneath conveyor 32*b* in such a manner that pencils drop from a second end of conveyor 32*b* to a corresponding end of conveyor 34*b* (see downwardly curved arrow in FIG. 2). Conveyor 34b is supported on a frame (diagrammatically indicated by elements 33b, 35b, 37b, and 39b) and runs in a horizontal direction parallel and opposite to that of conveyor 32b, with a slight downward incline. Retaining walls such as wall 36b project upwardly from the sides of conveyor 34b so that the dry pencils may stack thereon. The remaining end of conveyor 34b is positioned adjacent the lower end of another inclined conveyor 22c, which is part of the supply conveyor means 20c of station C, so that pencils may be discharged from conveyor 34b to inclined conveyor 22c. Inclined conveyor 22b of station B is similarly cooperable with the second conveyor 34a of drying conveyor means 30a of station A, as shown. It will be appreciated that further drying of the paint applied by paint means 10b takes place on conveyor 34b. In particular, while the paint has already dried sufficiently on conveyor 32b so that the pencils will not stick together, the paint solvents continue to migrate from the stacked pencils as they move along conveyor 34b. Thus conveyor 34b provides the advantage of further drying time.

As noted hereinabove, it may be preferable to stack pencils on conveyors 24b and 34b. In a practical embodiment of the invention, this can be accomplished as follows. First, with respect to conveyor 24b, a guide 29b, shown diagrammatically in FIG. 3, may be positioned at the upper end of inclined conveyor 22b. The guide may include a curved sheet of non-stick material (e.g., "TEFLON") supported in any suitable manner adjacent the upper roller of conveyor 22b so that pencils are constrained between the conveyor and the guide sheet and carried over a top portion of the roller. When the pencils pass beyond the guide sheet, they drop to conveyor 24b which runs at a slow speed relative to conveyor 22b. Initially, as the first pencils approach conveyor 24b, a block of desired height (e.g., 12 inches) may be placed across that conveyor to prevent the pencils from rolling forward. Due to the relative speeds of conveyors 22b and 24b, the pencils will form a stack behind the block. The stack height will depend on the actual conveyor speeds in a particular application. When the stack reaches a sufficient length to support itself on the conveyor (e.g., 12 inches with a stack height of 12 inches) the block may be removed. As will be readily apparent to those skilled in the art, guide 29b may also include suitable lateral guide members to ensure that the pencils do not skew (i.e., to ensure they remain perpendicular to the direction of conveyor 24b) during stacking.

Notably, in connection with station A, it may be preferable in practice to stack the pencils as they exit the production line and to feed stacked pencils directly to conveyor 24a. This would permit the use of a simple belt conveyor, rather than an inclined conveyor of the type discussed earlier, to supply conveyor 24a.

To effect stacking on conveyor 34b, a guide arrangement 38b, also shown diagrammatically in FIG. 3, similar to guide 29b may be employed. Guide 38b may include, for example, a "TEFLON" guide sheet of semicircular cross-section supported adjacent the rollers at the discharge end of conveyor 32b so that pencils are constrained between the guide sheet and the conveyor belts until they reach the bottom of the rollers. At that point the guide sheet terminates and the pencils drop vertically to an end of conveyor 34b. Again, suitable lateral guides may be provided to prevent the pencils from skewing, and a block can be used to effectuate initial stacking. Naturally, conveyor 34b runs at a slow speed relative to conveyor 32b to permit stacking to occur. An appropriate stacking height for conveyor 34b would be 6–8 inches, with the block being removed when the stack reaches 12 inches in length.

At the opposite end of conveyor 34b, the stacked pencils may be brought into direct abutment with conveyor 22c, as depicted diagrammatically in FIG. 3. There, the pencils locate in the spaces between the transverse members of conveyor 22c (which may be spaced to accommodate two pencils at a time, for example) and are then transported to the next conveyor (not shown). A hopper arrangement (not shown) of any appropriate configuration may be located at the adjacent ends of conveyors 34b and 22c to contain the pencils until they are picked up by the latter conveyor. Naturally, the relative speeds of these two conveyors are such that pencils will not overflow from such a hopper arrangement. It may also be appropriate in particular applications to employ an inclined guide adjacent the working surface of conveyor 22c to ensure that pencils will not fall therefrom.

While it will be apparent that various conveyor and painting device arrangements can be used in a pencil painting system according to the invention, the particular arrangement shown herein provides the advantage of a highly compact system. First, it will be appreciated that with the arrangement of the respective drying conveyor means as described in connection with station B the distance between the painting devices of adjacent paint stations, and thus the length of the entire system, can be minimized. More particularly, if the first and second conveyors of each drying conveyor means were arranged end-to-end with both conveyors running in the same direction as the corresponding supply conveyor means, as opposed to the overunder arrangement described, it would obviously be necessary to space adjacent painting devices further apart. Second, with adjacent consecutive stations, such as A and B, oriented so that the respective pencil feed paths of the associated painting devices are oppositely directed (as exemplified by the directions of arrows 16a and 16b) the system can be linearly arranged in the manner of FIG. 1, thus further reducing floor space requirements.

While a preferred embodiment of the invention has been shown and described herein, it will be apparent to those skilled in the art that numerous changes and modifications may be made within the scope of the invention which is defined in the appended claims. For example, it would be possible, although less advantageous, to transport pencils between adjacent painting devices using a single conveyor running between the reservoir output of the earlier station and the supply hopper of the latter station in sequence.

We claim:

1. A system for automatically applying multiple coats of paint to unfinished pencils from a pencil production line, comprising a plurality of paint stations each including paint means for receiving said pencils and applying paint completely about the respective peripheral surfaces of said pencils, supply conveyor means for discharging said pencils to said paint means, and elongate drying conveyor means for receiving said pencils from said paint means and drying the paint applied by said paint means, said plurality of stations being arranged in sequence for successively applying paint to said pencils, with the supply conveyor means of the first station in sequence having a zone for receiving said pencils from said production line and the supply conveyor means of each subsequent station being respectively cooperable with the drying conveyor means of the corresponding preceding station in sequence so that pencils may be transported automatically from one paint station to the next, and with the drying conveyor means of the last station in sequence having a zone from which said pencils exit the system.

2. A system in accordance with claim 1, wherein said paint means comprises a pencil painting device of the type having a pencil supply hopper, a paint reservoir adjacent the hopper and means for feeding pencils from the hopper longitudinally through the reservoir along a substantially horizontal path, wherein the supply conveyor means of each paint station is disposed for discharging pencils to the supply hopper of the painting device associated with that station, and wherein the drying conveyor means of each paint station is disposed for receiving pencils as they exit from the paint reservoir of the associated painting device.

3. A system in accordance with claim 2, wherein the painting devices of at least two consecutive stations are oriented so that their respective pencil feed paths are substantially parallel and wherein the cooperable drying and supply conveyor means between each pair of said consecutive stations extend in a horizontal direction transverse to said paths.

4. A system in accordance with claim 3, wherein the respective painting devices of adjacent consecutive stations are oriented so that their respective pencil feed paths are oppositely directed.

5. A system in accordance with claim 2, wherein the supply conveyor means of at least one station includes lift conveyor means and extends in a first horizontal direction transverse to the pencil feed path of the corresponding painting device, with one end disposed above the supply hopper of that painting device for discharging pencils thereinto, wherein the drying conveyor means of said one station includes a first elongate conveyor running in a second horizontal direction opposite to said first horizontal direction and having one end adjacent the paint reservoir of said corresponding painting device for receiving pencils therefrom, and a second elongate conveyor running in said first horizontal direction beneath said first conveyor and disposed so that pencils drop from said first conveyor to the second conveyor.

6. A system in accordance with claim 5, wherein said supply conveyor means includes an upwardly inclined elongate conveyor for lifting pencils toward the supply hopper of said corresponding painting device and a further elongate conveyor with one end positioned above that hopper for discharging pencils thereinto and another end adjacent the upper end of said inclined conveyor for receiving pencils therefrom.

7. A system including at least two paint stations as recited in claim 6, and wherein the inclined conveyor of the latter of said two stations in sequence has one end disposed adjacent an end of the second conveyor of the drying conveyor means of the earlier station in sequence for receiving pencils from that end of that second conveyor.

8. A system in accordance with claim 5, wherein said second conveyor operates at a slower speed than said first conveyor, whereby pencils dropped from said first conveyor to said second conveyor stack on said second conveyor.

9. A system in accordance with claim 6, wherein said further conveyor operates at a slower speed than said inclined conveyor, whereby pencils received on said further conveyor from said inclined conveyor stack on said further conveyor.

10. A system for automatically applying multiple coats of paint to pencils, comprising a plurality of paint stations arranged in sequence for sucessively applying paint to said pencils, each of said paint stations including point means for receiving said pencils and applying paint completely about the respective peripheral surfaces of said pencils, elongated supply conveyor means having an end disposed adjacent one side of said paint means for discharging said pencils to said paint means, and elongate drying conveyor means having an end disposed adjacent another side of said paint means for receiving painted pencils from said paint means, with said supply conveyor means and said drying conveyor means extending substantially parallel to one another, said pencils being received on said supply conveyor means and said drying conveyor means with the respective lengths of said pencils being substantially perpedicular to said supply conveyor means and said drying conveyor means, and with said paint means having a pencil feed path along which said pencils pass longitudinally, substantially perpendicular to said supply conveyor means and said drying conveyor means; said system havind the drying conveyor means of each of said stations cooperable with the supply conveyor means of the next of said stations in sequence, if any, whereby said pencils may pass automatically from one station to the next; said system further having the pencil feed path of the paint means of each of said stations oppositely directed from the pencil feed path of the paint means of any other of said stations adjacent in sequence and having the drying conveyor means of each of said stations substantially aligned with the supply conveyor means of any other of said stations adjacent in sequence, whereby the system has a generally linear configuration.

11. A system in accordance with claim 10, wherein the drying conveyor means of each of said stations includes a first elongate drying conveyor running in a direction substantially opposite the supply conveyor means of that station and having a receiving end adjacent said another side of the paint means of that station, and a second elongate drying conveyor disposed beneath said first drying conveyor and running in a direction substantially the same as the supply conveyor means of that station, said second drying conveyor having a receiving end positioned under a discharge end of said first drying conveyor so that pencils may drop from said first drying conveyor to said second drying conveyor.

12. A system in accordance with claim 11, wherein said second drying conveyor operates at a slower speed than said first drying conveyor, whereby pencils dropped from said first drying conveyor to said second drying conveyor stack on said second drying conveyor.

13. A system in accordance with claim 11, wherein said second drying conveyor has a discharge end cooperable with the supply conveyor means of the next station in sequence, if any.

14. A system in accordance with claim 13, wherein said supply conveyor means of said next station includes a first elongate supply conveyor of a lift type having a receiving end disposed to receive pencils from said discharge end of said second drying conveyor, and a second elongate supply conveyor having a receiving end disposed to receive pencils from said first supply conveyor and a discharge end adjacent said one side of the paint means of said next station.

15. A system in accordance with claim 14, wherein said second supply conveyor operates at a slower speed than said first supply conveyor, whereby pencils received on said second supply conveyor from said first supply conveyor stack on said second supply conveyor.

* * * * *